US006509824B2

(12) United States Patent
Inaba et al.

(10) Patent No.: US 6,509,824 B2
(45) Date of Patent: Jan. 21, 2003

(54) FUSE UNIT AND METHOD OF MANUFACTURING FUSE UNIT

(75) Inventors: Shigemitsu Inaba, Shizuoka (JP); Norio Matsumura, Shizuoka (JP); Yasuyuki Hama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 91 days.

(21) Appl. No.: 09/779,625

(22) Filed: Feb. 9, 2001

(65) Prior Publication Data

US 2001/0011939 A1 Aug. 9, 2001

(30) Foreign Application Priority Data

Feb. 9, 2000 (JP) ..... 2000-031668
Jan. 30, 2001 (JP) ..... 2001-021805

(51) Int. Cl.[7] ..... H01H 85/08; H01H 69/02; H01R 33/95

(52) U.S. Cl. ..... 337/295; 337/256; 337/159; 337/161; 337/292; 439/621; 29/623

(58) Field of Search ..... 337/256, 159, 337/161, 186, 187, 198, 268, 290, 292, 295; 29/623; 439/621, 622, 890

(56) References Cited

U.S. PATENT DOCUMENTS 4,531,806 A * 7/1985 Hsieh ..... 337/188
5,581,225 A * 12/1996 Oh et al. ..... 337/261
5,731,944 A * 3/1998 Yasukuni et al. ..... 361/104
5,790,007 A * 8/1998 Yasukuni ..... 29/623
5,805,047 A * 9/1998 De Villeroche et al. .... 337/142
5,805,048 A * 9/1998 Saitoh et al. ..... 337/268
5,841,338 A * 11/1998 Yasukuni ..... 337/164
6,147,586 A * 11/2000 Saitoh et al. ..... 29/623
6,294,978 B1 * 9/2001 Endo et al. ..... 337/159

FOREIGN PATENT DOCUMENTS

DE 198 01 596 A1 7/1999
EP 0 884 750 A2 12/1998
JP 9-204870 A * 8/1997 ..... H01H/85/08
JP 11-041751 A * 12/1999 ..... H02G/3/16

OTHER PUBLICATIONS

Patent Abstracts of Japan, JP 2000 164111 A, Jun. 16, 2000.
Patent Abstracts of Japan, JP 2000 182506 A, Jun. 30, 2000.

* cited by examiner

*Primary Examiner*—Anatoly Vortman
(74) *Attorney, Agent, or Firm*—Sughrue Mion, PLLC

(57) ABSTRACT

An electrically conductive fuse element including fusible portions has a hinge portion provided at a middle portion thereof. A resin body is divided into resin body parts so that the resin body parts are provided around the fuse element in such a way as to be separated by the hinge portion. One of the resin body parts is bent from the hinge portion. The fuse element has abutting faces, against which the resin body parts are abutted in a bent state, and engaging means for the resin body parts. A connector housing is provided on the resin body part. Further, a terminal is provided at one of plate portions of the fuse element. Power supply connecting portions and terminal connecting portions are provided in the other plate portion connected to the plate portion through the hinge portion.

17 Claims, 12 Drawing Sheets

FUSE UNIT AND METHOD OF MANUFACTURING FUSE UNIT

BACKGROUND OF THE INVENTION

1. Technical Field

The present invention relates to a fuse unit connected to, for example, a battery, for supplying electric power to each electric wire through a plurality of fusible portions, and also relates to a method of manufacturing such a fuse unit.

2. Related Art

FIG. 17 illustrates the configuration of a related fuse unit.

A fuse unit 91 connects a battery 89 of a vehicle to electric wires 75 and 76 for supplying electric power. The fuse unit 91 comprises a plate-like fuse element 85 including a fusible portion 79 and made of an electrically conductive metal, and a nearly L-shaped insulating resin body 84, in which the fuse element 85 is insert-molded.

The fusible portion 79 is provided at a middle portion of the fuse element 85 and placed in a cavity 78 of the resin body 84 and has a metal chip 77 comprising an alloy of tin and zinc. The fuse unit 91 is formed in such a way as to be bent at right angles from a middle portion thereof. The fusible portion 79 is placed in a horizontal position.

An end portion extending in a horizontal direction of a fuse element 85 is fastened and connected in vertical direction to a stud bolt 81*a* of a battery terminal 81 together with a first terminal attached wire 90 by tightening a nut 87. A second terminal attached wire 82 is fastened and connected in the horizontal direction (or lateral direction) to the other end portion extending in a vertical direction of the huge element 85 with the stud bolt 86 and the nut 88. The battery terminal 81 has a ring-like portion 81*b* fastened and connected to a battery post 89*a* with the bolt 75 and the nut 74.

A method of manufacturing the fuse unit 91 includes the following steps. That is, first, the fuse element 85 is stamped out from an electrically conductive metal plate (not shown) The fuse element 85 is then bent from a middle portion thereof at right angles. Subsequently, the fuse element 85 is set in a resin molding die (not shown). A molten resin material is then injected into the resin molding die, so that the resin body 84 is integrally formed on each of the top and bottom surfaces of the fuse element 85 in such a manner as to be bent nearly like a letter "L". At that time, parts of the resin body 84, which are connected to the terminals 82 and 90 and surround around the fusible portion 79, are cut out, so that the surface of the conductive material of the fuse element 85 is partly exposed.

The related fuse unit 91 and the manufacturing method therefor have drawbacks in that the drawing structure of the resin molding die becomes complicated due to forming of the resin body 84 in such a way as to be nearly L-shaped, and that the manufacturing cost of the fuse unit is high. Moreover, the related fuse unit 91 and the manufacturing method therefor have another drawback in that the entire length $L_i$ of the fuse unit 91 is long, and a large space is thus needed when the set number of fusible portions 79 of the fuse element 85 is increased. Especially, in the case that the set number of the fusible portions 79 is large, the fusible portions 79 are disposed on both the horizontal side and the vertical side of the fuse unit 91, which is bent at right angles, so as to prevent an increase in the size of the fuse unit 91. Thus, the related fuse unit 91 and the manufacturing method therefor have other drawbacks in that the structure of the fuse unit and the drawing structure of the resin molding die are complexed still more, that the fuse unit becomes more difficult to form, and that the cost of the fuse unit is much higher. The related fuse unit 91 and the manufacturing method therefor have another drawback in that the position of each of the fusible portions is restricted because the drawing directions corresponding to portions, which are respectively formed in such away as to extend in a horizontal direction and a vertical direction, of the resin body 84 are orthogonal to each other when the resin body 84 is resin-formed into a bent shape. Additionally, the related fuse unit 91 and the manufacturing method therefor have another drawback in that the fusible unit 91 cannot cope with the complexed circuit form of each circuit in a vehicle owing to a limited space in which each of the terminals is connected to the fuse element.

SUMMARY OF THE INVENTION

The present invention is accomplished in view of the aforementioned drawbacks. Accordingly, an object of the present invention to provide a fuse unit, which is formed into a bent shape and can simplify the structure of a resin molding die and reduce the cost thereof and prevent an increase in the size thereof and the mounting-side space thereof and easily obtain a bent shape and increase the flexibility of arrangement of fusible portions thereof and cope with the diversification of the circuit form of each circuit in a vehicle, and to a method of manufacturing such a fuse unit.

To achieve the foregoing object, according to the present invention, there is provided a fuse unit including: an electrically conductive fuse element including at least one fusible portion; a hinge portion provided at the electrically conductive fuse element so that the electrically conductive fuse element is separated into a first fuse element and a second fuse element by the hinge portion and is bendable from the hinge portion; a first resin body provided at the first fuse element; and a second resin body provided at the second fuse element.

According to the fuse unit of the present invention, the first and second resin bodies are respectively provided with abutting faces abutted together when the electrically conductive element is bent from the hinge portion.

According to the fuse unit of the present invention, the fuse unit further includes an engaging mechanism for engaging the first and second resin bodies each other when the electrically conductive element is bent from the hinge portion.

According to the fuse unit of the present invention, at least one first terminal is provided at the electrically conductive fuse element through the corresponding fusible portion, at least one connector housing for accommodating the at least one first terminal is provided in at least one of the first and second resin body.

According to the fuse unit of the present invention, a plurality of the terminals are provided in parallel with one another at the first fuse element, a power supply connecting portion is provided at the second fuse element.

According to the fuse unit of the present invention, at least one terminal connecting portion is provided at the second fuse element.

According to the fuse unit of the present invention, the second fuse element is formed of a first fuse plate connected to the hinge portion and a second fuse plate connected to the first fuse plate through one of the fusible portion, one of the at least one terminal connecting portion for a second terminal is provided at the first fuse plate, the power supply connecting portion is provided at the second fuse plate.

According to the fuse unit of the present invention, the second fuse element is narrower than the first fuse element, a third terminal is placed in a side space at a side of the second fuse element and connected to the power supply connecting portion.

According to the fuse unit of the present invention, the first fuse plate is narrower than the first fuse element, the second fuse plate to which the third terminal is connected is placed in a side space at a side of the first fuse plate.

According to the fuse unit of the present invention, the electrically conductive fuse element is divided in a direction perpendicular to a direction in which the hinge portion extends into a first division portion including a part of the first fuse element and a second division portion including the other part of the first fuse element, the first division portion is connected to the second division portion through one of the fusible portions, the first and second division portion are respectively provided with the first terminals and second terminals.

According to the fuse element of the present invention, the first terminal is for connecting an alternator, the second terminal is for connecting a starter motor, a current branched from the first terminal is supplied to an electric connection box through the fusible portion the said first terminal.

According to the fuse unit of the present invention, the third terminals are positioned between the first fuse element and a battery.

To achieve the foregoing object, according to the present invention, there is provided a method of manufacturing a fuse unit comprising the steps of: providing an electrically conductive fuse element including at least one fusible portion; forming a hinge portion at the electrically conductive fuse element for dividing the electrically conductive fuse element into a first fuse element and a second fuse element; and integrally forming an insulating resin material with the first and second fuse elements in a state in which the electrically conductive fuse element is flattened out.

According to the method of manufacturing the fuse unit of the present invention, the insulating resin material is formed with opposite sides of the first and second fuse elements.

According to the method of manufacturing the fuse unit of the present invention, a space, to which the at least one fusible portion is exposed, is formed at the insulating resin material.

According to the method of manufacturing the fuse unit of the present invention, a connector housing for accommodating a terminal connected to one of the at least one fusible portion is formed at the insulating resin material.

According to the method of manufacturing the fuse unit of the present invention, a exposed portion of the second fuse element corresponding to a terminal contact portion is formed at the insulating resin material.

DETAILED DESCRIPTION OF PREFERRED EMBODIMENTS

Figure 1A:
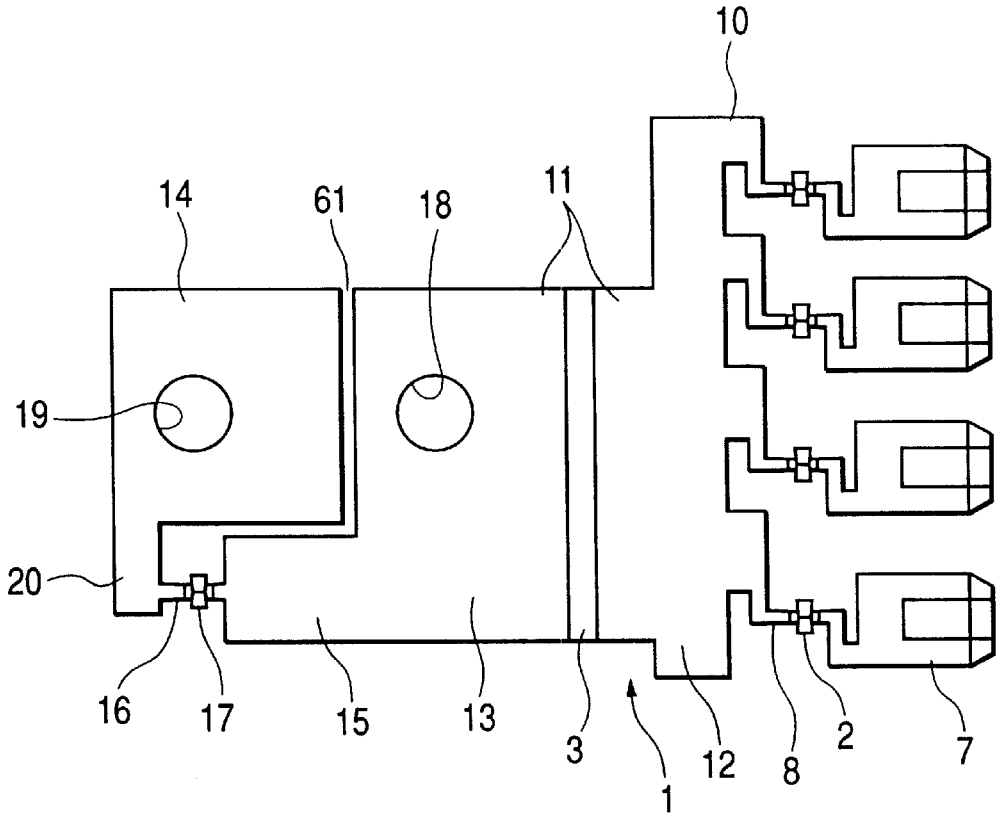
FIG. 1A is a plan view illustrating a fuse element, which embodies the present invention, of a fuse unit.

Hereinafter, embodiments of the present invention will be described in detail herein after by referring to the drawings.

First Embodiment

FIGS. 1A to 2B illustrates a fuse unit, which is a first embodiment of the present invention, in the order of the manufacturing steps thereof.

Figure 1B:
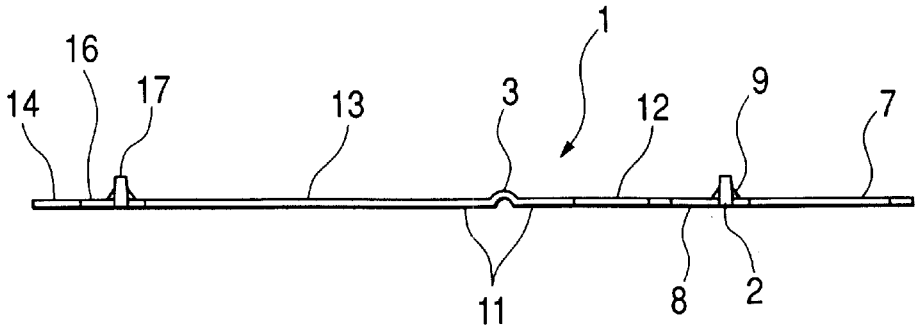
FIG. 1B is a side view of this fuse element.

FIGS 1A and 1B illustrate a state in which a fuse element 1 made of an electrically conductive metal including a plurality of fusible portions 2 is formed by being stamped out from an electrically conductive metal plate. The fuse element 1 has a flexible hinge portion (namely, a flexible portion) 3 integrally formed with a middle portion thereof. The fuse element 1 is enabled to bend in the direction of thickness thereof from the hinge portion 3. In the case that the hinge portion 3 is equal to the fuse element 1 in thickness, the hinge portion 3 is sufficiently flexible.

Figure 2A:
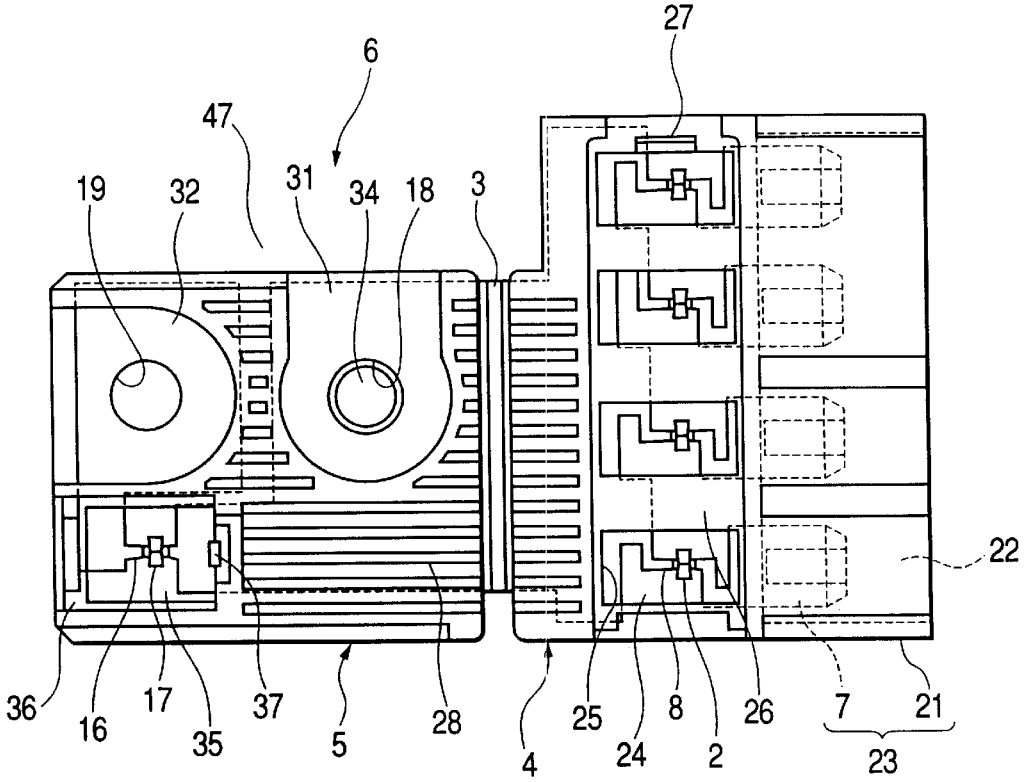
FIG. 2A is a plan view illustrating a fuse unit, which is a first embodiment of the present invention.
Figure 2B:
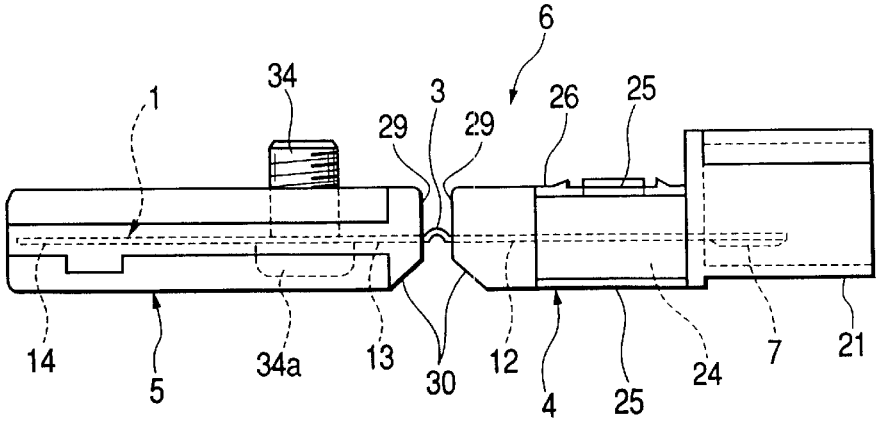
FIG. 2B is a side view of this fuse unit.

FIGS. 2A and 2B illustrate a completed state of a fuse unit 6 in which resin body parts 4 and 5 each made of an insulating synthetic resin material are integrally formed on the top and bottom surfaces of the fuse element 1 by keeping the fuse element 1 flattened like a plate in a one-dimensional direction. The hinge portion 3 of the fuse element 1 is completely exposed to the outside from the resin body parts 4 and 5 by being disposed in a portion, into which no resin material is injected, of a resin molding die (not shown). The hinge portion 3 is integral with the fuse element 1 and electrically conductive. The resin body parts 4 and 5 are formed along both sides of the hinge portion 3 in such a manner as to be separated from each other in frontward and rearward directions of the hinge portion 3, respectively.

As illustrated in FIG. 1A, the fuse element 1 has a plurality of (in this embodiment, four) tab terminals (corresponding to the terminal of the present invention) 7 arranged therewith at an equal pitch in parallel at the front-end side thereof. Each of the tab terminals 7 is connected and leads to a narrow portion 8 bent nearly like a crank. A narrower fusible portion 2 is formed in a middle part extending in the longitudinal direction of each of the narrow portions 8. Each of the narrow portions 8 leads to a plate-like wide portion 10 provided at an end-portion side of the fuse element 1. The wide portion leads to a substantially rectangular plate portion 11, whose width is somewhat narrow and almost three times the width of the tab terminal. The hinge portion 3 is formed near to an end part of the plate portion 11 in such a way as to straight extend in a transverse direction of the plate portion 11. A first plate portion 12 is defined herein as a front-side plate portion including a wide portion 10 bounded by the hinge portion 3.

As illustrated in FIG. 1B, in this embodiment, the hinge portion 3 is upwardly curved nearly like an arc, and enabled to bent in such a way as to downwardly turn the plate portions 11 provided on both sides of the hinge portion 3. As illustrated in FIG. 1A, the hinge portion 3 is formed on the side of the somewhat narrow plate portion 11, instead of the side of the wide portion 10 having the fusible portions 2 and the tab terminals 7. Thus, the required length of the hinge portion 3 is short, and the bendability thereof is good. Consequently, the fuse unit can easily bend, and there is no fear of an occurrence of a fatigue failure of the hinge portion 3. Even when the hinge portion 3 is formed like a plate, instead of being bent nearly like an arc, the hinge portion 3 can sufficiently bend.

As illustrated in FIG. 1A, a bolt insertion hole 18 for connecting a terminal is provided in a rear-side plate portion (that is, a second plate portion) 13 connected to the hinge portion 3. The second plate portion 13 has a narrow extension portion 15 at the rear end side thereof. Moreover, a somewhat small third plate portion 14, which is formed nearly like a square, is connected to the rear end of the extension portion 15 through a short and straight thin portion 16. A single fusible portion 17 similar to the fusible portions 2 is formed in a middle portion of the thin portion 16. A bolt insertion hole 19 is formed in the third plate portion 14 at the rear side of and in parallel with the bolt insertion hole 18. The third plate portion 14 has a short and narrow extension portion 20, which sidewardly protrudes and is connected to the thin portion 16. The third plate portion 14 is placed so that a slit-like gap 61 is provided in an inner space between the plate portion 14 and the extension portion 15.

As illustrated in FIG. 2A, in a state in which a fuse element 6 is insert-molded into the resin body parts 4 and 5, each of the tab terminals 7 is disposed in such a way as to protrude into a connector fitting chamber 22 of a female connector housing 21 integrally formed with the front-side first resin body part 4. A female connector 23 consists of the tab terminals 7 and the connector housing 21.

A crank-like thin portion 8 connected to each of the tab terminals 7 is placed together with the fusible portion 2 in a cavity (or space) 24 in the resin body part 4. A cover 26 having a transparent window portion 25 covers the upper, lower and side parts, namely, the entirety of each of the cavities 24. The cover 26 is attached to the resin body part 4 by the engaging means 27. For example, an engaging projection or an engaging hole is used as the engaging means 27. The first resin body part 4 provided on the front side of the hinge portion 3 is formed in such a manner as to be relatively wide. The second resin body part 5 provided on the rear side of the hinge portion 3 is formed in such a manner as to be relatively narrow. A plurality of radiating fins 28 are integrally formed in the resin body parts that cover the plate portions 12 to 14.

The resin body parts 4 and 5 are placed on both the front and rear sides of the hinge portion 3 in such a way as to face each other. The hinge portion 3 and a small part of each of the plate portions 12 and 13 connected to the hinge portion 3 are exposed to the space between the opposed surfaces 29 of the resin body parts 4 and 5. This enables the hinge portion 3 to bend. As illustrated in FIG. 2B, the fuse element 1 and the hinge portion 3 are placed at the central portion in the direction of height of each of the resin body parts 4 and 5. In the present specification, for convenience of description, a side toward the tab terminal 7 from the hinge portion 3 is defined as a "front side". A side toward the battery from the hinge portion 3 is defined as a "rear side".

Each of the opposed end surfaces 29 of the resin body parts 4 and 5 leads to an inclined surface (or abutting face) 30, which is inclined at 45° to horizontal, below the hinge portion 3. The inclined surfaces 30 are opposed to each other so that the opening angle therebetween is approximately 90°. As will be described later, when one of the resin body parts 4 and 5 is bent with respect to the other at right angles, both the inclined surfaces 30 are joined together and act as stoppers. At that time, both the resin body parts 4 and 5 are engaged by the engaging means (to be described later), which are provided for such a purpose at the opposed end portions of the resin body parts 4 and 5.

The second plate portion 13 and the third plate portion 14 of the fuse element 1 is embedded in the rear-side (or second) resin body part 5. The bolt insertion holes 18 and 19, which are respectively formed in the plate portions 13 and 14, and vicinities thereof are exposed from the resin body part 5. Only the top surfaces of the front-side first bolt insertion hole (namely, the connecting hole) 18 and the vicinities thereof are exposed therefrom. The top and bottom surfaces of the rear-side second bolt insertion hole (namely, the power supply connecting portion) 19 and the vicinities thereof are exposed therefrom. Each of the upper exposed surfaces 31 and 32 has a shape of a combination of a rectangle and a semicircle. The lower exposed surface 33 (see FIG. 6) is shaped like a rectangle. Any of the exposed surfaces (corresponding to the terminal contact portion) 31 to 33 has an end connected to the end portion of the resin body part 5 that has a cutout at the end portion thereof. The insertion hole 19 and the exposed surfaces 32, 33 constitute the power supply connecting portion and the terminal connecting portion.

A stud bolt 34 is inserted into the first bolt insertion hole 18. When insert-molded, the head 34*a* of the stud bolt 34 can be simultaneously fixed. The exposed surface 31 and the stud bolt 34 compose the terminal connecting portion. The thin portion 16 connecting the second plate portion 13 to the third plate portion 14, and the vicinities of the portion 16 are placed in the cavity (or space) 35 of the second resin body 5. The cavity 35 is covered by a cover having a transparent window portion. The cover 36 is attached to the resin body part 5 by the engaging means 37. Each of the covers 26 and 36 respectively provided at the sides of the first and second resin body parts can be rotatably provided through a hinge. This facilitates the assembly of the fuse unit and thus the assemblability of the fuse unit is enhanced.

The resin molding is easily achieved by performing resin-molding in a state in which the first and second resin body parts 4 and 5 are flattened out on the same plane, as shown in FIGS. 2A and 2B. Especially, all (that is, five) of the cavities (or spaces) 24 and 35 can simultaneously and easily be formed by drawing a resin molding die (not shown) in upward and downward directions.

For example, when a fuse unit bent like a letter "L" is resin-molded according to the conventional method, it is necessary for forming a cavity, which accommodates a fusible portion, in each of the resin body parts to perform die-drawing in two orthogonal directions, namely, the X-axis and the Y-axis. Thus, the structure of the molding die is complex. According to the manufacturing method of this embodiment, the first and second resin body parts 4 and 5 are resin-molded and put into a state, in which the parts 4 and 5 are flattened out on the same plane and subsequently bending the fuse element 1 from the hinge portion 3 so that the resin body parts 4 and 5 are inclined to each other. Thus, the direction, in which the molding die is drawn, is only the XX' direction (namely, the direction of 180°). The molding die is simplified in structure and reduced in cost. Moreover, the number of steps of a molding process can be decreased. Thus, the molding is facilitated, and the cost of the fuse unit is reduced.

The cavities 24 and 35 are formed as follows. For instance, during a projected portion of the upper molding die (not shown) is made to abut against the top surface of each of the thin portions 8 and 16 of the fuse element 1 and a projected portion of the lower molding die (not shown) is made to abut against the bottom surface of each of the thin portions 8 and 16, molten resin material is filled into the molding die. After the resin material is set, the projected portions are released from the resin material by opening the molding die. Thus, the cavities 24 and 35 are formed. The direction, in which each of the upper and lower projected portions (not shown) is drawn, is the direction of 180°. Consequently, there is no fear of an occurrence of the interference between the projected portions. Each of the fusible portions 2 and 17 can be set at desired places. Thus, the flexibility of the position of each of the fusible portions 2 and 17 is enhanced. The connecting direction of a terminal with wire (to be described later) can be favorably set, so that the workability in a connecting process is improved.

FIGS. 3 to 6 illustrate a state in which the fuse unit 1 is attached to the battery 40 after the fuse unit 1 is bent at right angles from the hinge portion 3.

Figure 3:
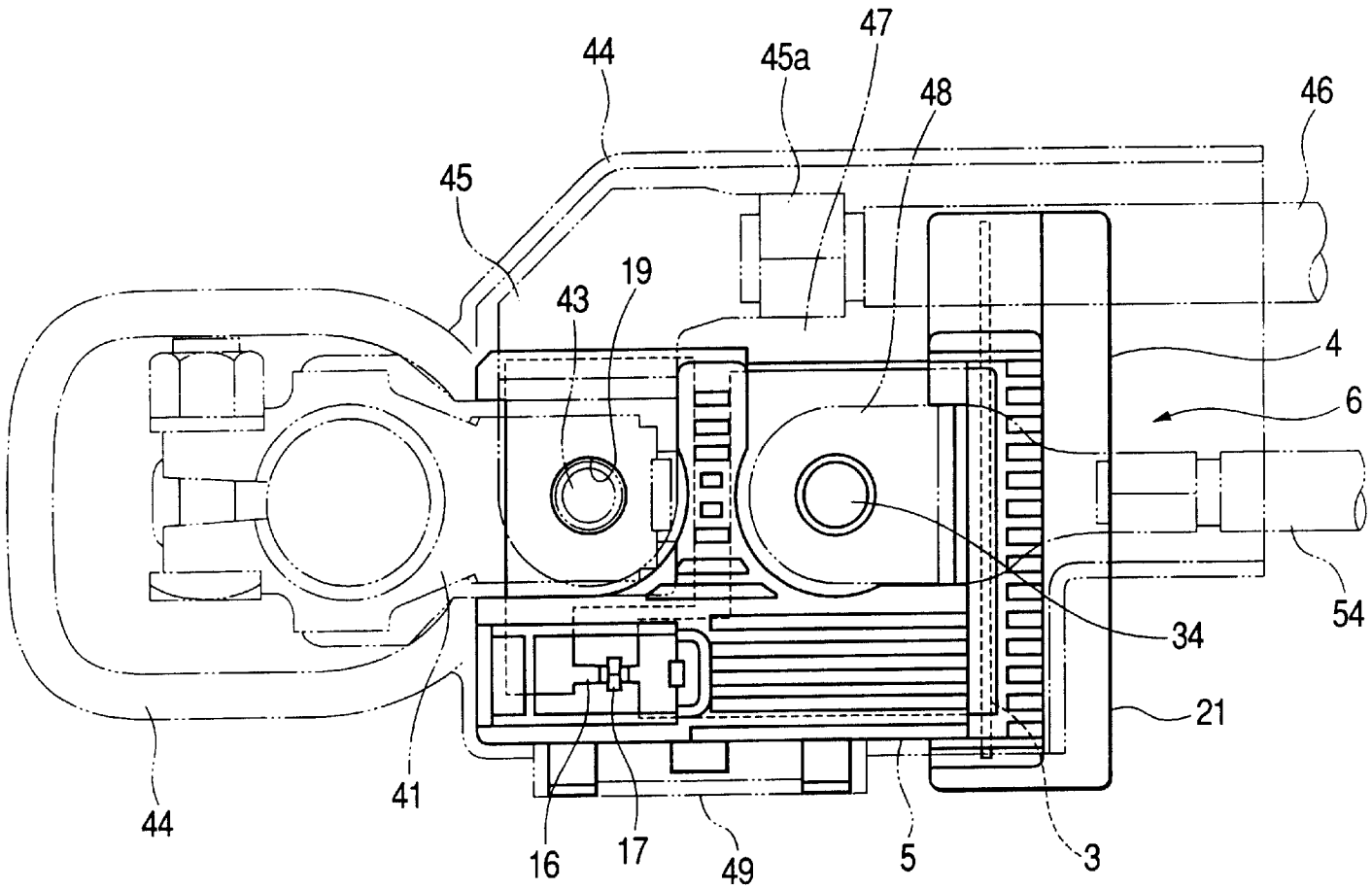
FIG. 3 is a plan view illustrating a state in which the fuse unit is bent and then connected to a battery.
Figure 4:
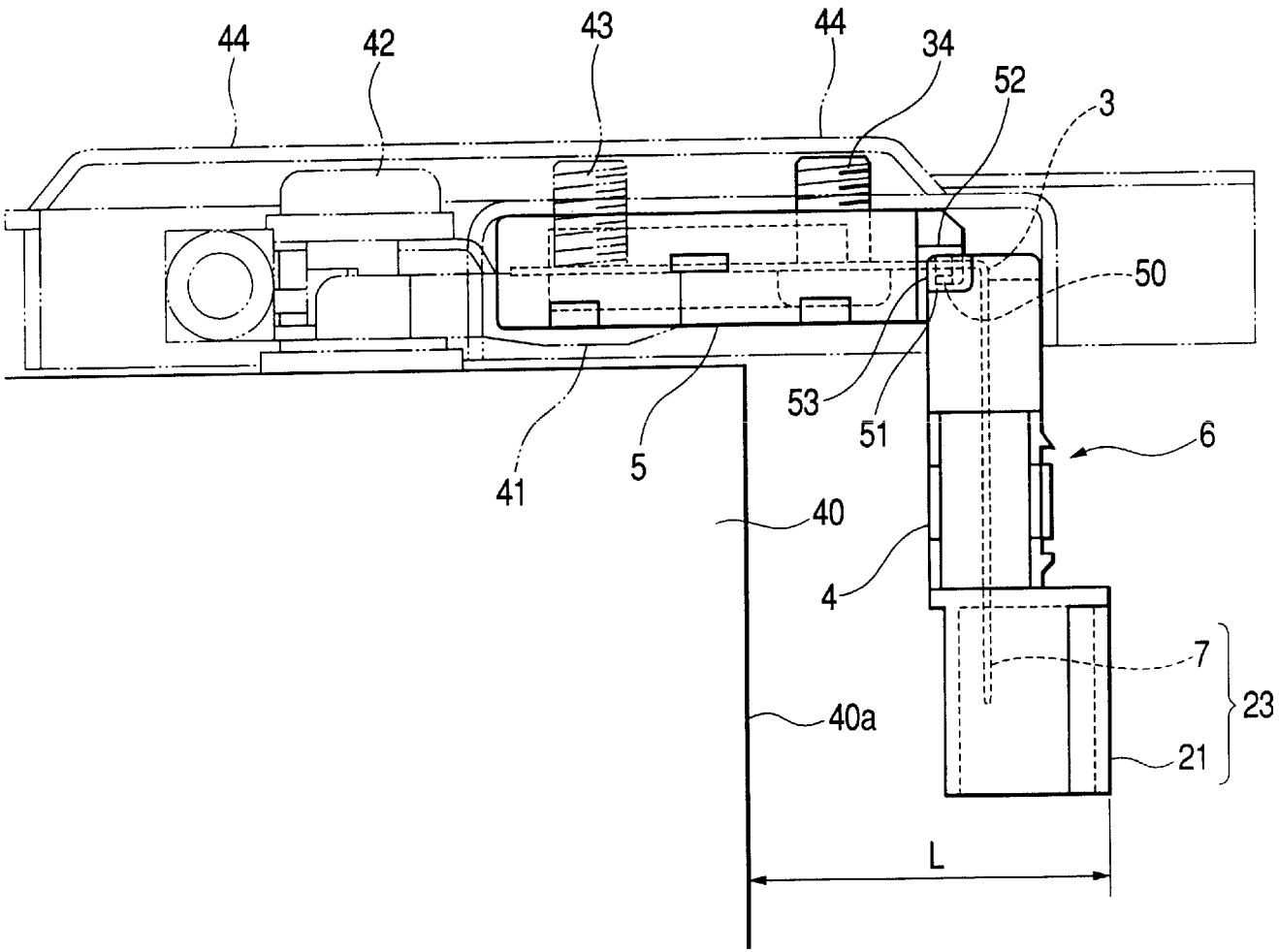
FIG. 4 is a side view illustrating a state in which the fuse unit is bent.

In FIGS. 3 and 4, reference numeral 41 designates a battery terminal. Reference numeral 42 denotes a battery post. Reference numeral 43 designates a stud bolt at the side of the battery terminal 41. Reference numeral 44 denotes a waterproof and dustproof insulating cover for covering the fuse unit 6.

As illustrated in FIG. 3, a rear-side bolt insertion hole 19 of the fuse element 1 is engaged with the stud bolt 43. Moreover, an insertion hole of a plate-like terminal (namely, the second terminal or the second power feeding terminal) 45 for connecting a starter motor is engaged with the stud bolt 43. Then, both the fuse element 1 and the terminal 45 are bolted by tightening a nut (not shown). Thus, the terminal 45 is connected to the battery 40. The terminal 45 is bent nearly like a letter "L" on a horizontal surface. A portion 45*a* at the side, to which an electric wire 46 is attached by pressure, is disposed by utilizing the side space 47 provided on the side of the second resin body part 5. The portion 45*a* extends above one side of the first resin body part 4, which is bent downwardly from the hinge portion 3, and leads to the front thereof. As illustrated in FIG. 2A, a larger number (in this embodiment, four) of the fusible portions 2 are placed in the first resin body part 4 in parallel. A smaller number (in this embodiment, one) of the fusible portions 17 are disposed in the second resin body part 5. Thus, a side space 47 used for placing the terminals is provided along one side of the second resin body part 5. Consequently, the entire connecting structure is made to be compact.

A plate-like straight terminal (corresponding to the first terminal) 48 for connecting an alternator is connected to the front-side stud bolt 34, which is preliminarily attached to the fuse element 1, by using and tightening a nut, similarly as in the case of the terminal 45. A portion, to which electric wire is attached by pressure, of the terminal 48 extends above the hinge portion 3 and the central part of the end portion of the first resin body part 4 and leads to the front side of the fuse unit.

The cover 44 for covering the upper side of the fuse unit and the battery terminal 41 is rotatably supported by the hinge portion 49 on a side portion of the second resin body 5. As illustrated in FIG. 4, the first resin body 4 is bent at right angles downwardly from the hinge portion 3, so that the area of a portion to be covered by the cover 44 is reduced, and that the size of the cover 44 is decreased. The hinge portion 3 is curled almost like a ring in a state in which the hinge portion 3 is bent at right angles. Thus, the stress is distributed to the whole portion, so that occurrences of a fatigue failure and a failure with the passage of time are prevented. The first resin body part 4 is placed along and in parallel with the side wall surface 40*a* of the battery 40 (see FIG. 4) in the vicinity of the battery 40. The first resin body 4 is bent at right angles, so that an amount L of projection of the resin body is decreased. Consequently, the space required for attaching the fuse unit is reduced.

Both the resin body parts 4 and 5 are caught in the vicinity of the hinge portion 3 by the engaging means, and held in a state in which the resin body is bent at right angles. A engaging projection 50 and one of an engaging hole 51 engaging the engaging projection 50 and an engaging frame portion (51) having an engaging hole are used as the engaging means. As illustrated in FIGS. 3 and 4, both sides of the end portion of the second resin body part 5 are cut out. A projecting wall 53 of the end portion of the first resin body part 4 is placed in the vicinity of and in parallel with an outer surface of a cutout portion 52 in such a manner as to cover the outer surface thereof. A catch projection 50 is formed on the outer surface of the cutout portion 52. The engaging hole 51 is provided in the projecting wall 53. The catch projection 50 has a downwardly facing inclined surface and an upwardly facing engaging surface. When the engaging projection 50 is engaged with the engaging hole 51, the resin body parts 4 and 5 are fixed in such a way as not to rattle and shift. This prevents the first resin body part 4 from being brought into contact with the other resin body part owing to the vibration of a vehicle during running. Thus, the fracture of the hinge portion 3 and the slippage of a counterpart connector (not shown) from the connector 23 are prevented.

As shown in FIG. 4, a male connector of a wire harness (not shown) is connected to the female connector 23 provided at the side of the first resin body part 4. Thus, electric power is supplied to each of electric wires of the wire harness. The connector 23 including a plurality of the tab terminals 7 is integrally formed with the fuse unit 6, so that electric power can be supplied to a plurality of electric wires, thus, to a wire harness (not shown) other than the electric wire 46 with the first terminal, and an electric wire 54 with the second terminal (see FIG. 3). The wire harness connected to the connector 23 is connected to an electric connection box (or junction block) by connector connection. Thus, electric power is supplied from the electric connection box to electrical equipment and auxiliary machinery. A conventional intermediate power supply connecting structure is simplified or omitted by supplying electric power directly to the electric connection box from the battery 40 through the connector 23 and the wire harness. Consequently, the space required for the fuse space is reduced. Moreover, the number of components is decreased.

The two stud bolts 34 and 43 are disposed in an assembled state of the fuse unit 6 in such a way as to upwardly extend. This facilitates operations of engaging each of the bolt insertion holes of the first and second terminals 45 and 48 with a corresponding one of the studbolts 34 and 43 and tightening nuts. The connector 23 is integrally formed with the first resin body part 4 in such a manner as to downwardly extend. Thus, the counterpart connector and the wire harness connected thereto are placed in such a manner as to downwardly extend, and do not project largely and frontwardly from the battery 40. This enables space-saving of a mounting room. The first resin body part 4 is downwardly bent together with the connector 23. This prevents an occurrence of the interference between the connector and each of the electric wires 46 and 54 and the terminals 45 and 48 shown in FIG. 3. Furthermore, this realize operations of smoothly connecting each of the terminals 45 and 48 to a corresponding one of the stud bolts 43 and 48 and smoothly cabling the electric wires 46 and 54.

Figure 5:
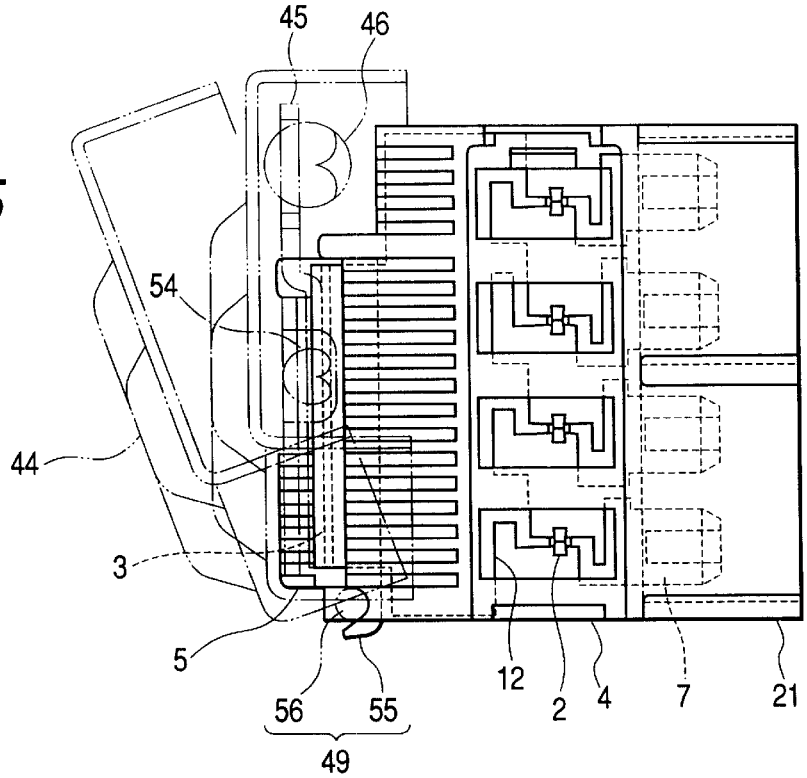
FIG. 5 is a front view illustrating the bent fuse unit.

As illustrated in FIG. 5, the cover 44 can be opened upwardly from the hinge portion 49. The hinge portion 49 comprises a nearly semi ring-like support portion 55, and a cover-side shaft portion 56 rotatably engaged with the support portion 55. The setting of the cover 44 in such a manner as to be rotatable (or openable) facilitates the operations of tightening and connecting the first and second terminals 45 and 48 and checking visually the upper fusible portion 17 (see FIG. 3).

Figure 6:
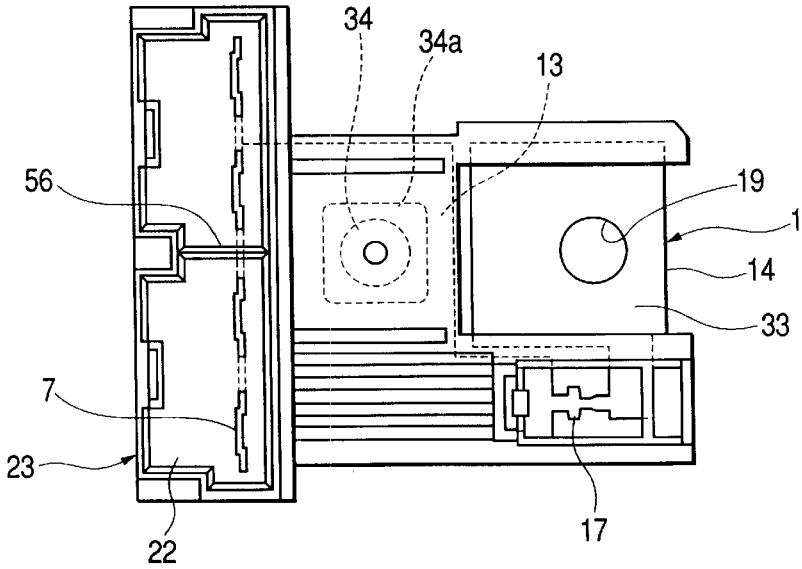
FIG. 6 is a bottom view illustrating the bent fuse unit.

As illustrated in FIG. 6, the female connector 23 has the four tab. terminals 7 in the connector fitting chamber 22 partitioned into two parts by an intermediate wall 56. Thus, the stiffness thereof is increased. The level of the insulation between the adjacent tab terminals 7 is raised. Each of the tab terminals 7 is connected through a corresponding one of the fusible portions 2 (see FIG. 5) to the first plate portion 12 of the fuse element 1. Reference character 34*a* designates the head of the stud bolt 34 that is in contact with the second plate portion 13 of the fuse element 1. Reference character 19 denotes a bolt insertion hole of the third plate portion 14 of the fuse element 1. Reference numeral 17 designates a fusible portion connecting the second plate portion 13 to the third plate portion 14. The battery terminal 41 (see FIG. 4) is in contact with the rear surface 33 of the exposed third plate portion 14.

Figure 7:
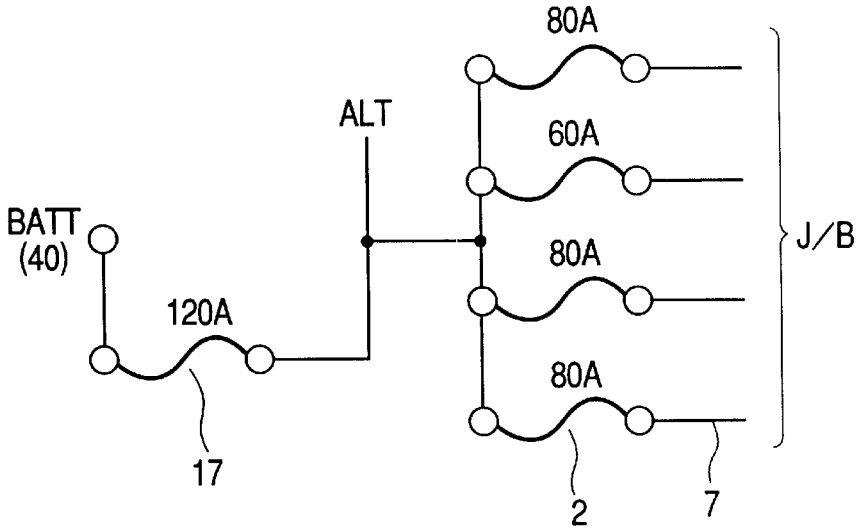
FIG. 7 is a circuit diagram illustrating a state in which the fuse unit is connected to a battery and terminals.

FIG. 7 is a circuit diagram illustrating the fuse unit 6 connected to the battery 40.

Electric currents are supplied from the battery to the starter motor through the third plate portion 14 of the fuse element 1 (see FIG. 1)and the second terminal 45 (see FIG. 3). Charging currents are supplied from the alternator to the electric connection box (J/B) through the electric wire 54 (see FIG. 3), the first terminal 48, and the second plate portion 14 and the four fuses 60A to 80A (namely, the fusible portions 2) of the fuse element 1 (see FIG. 1).

Second Embodiment

Figure 9:
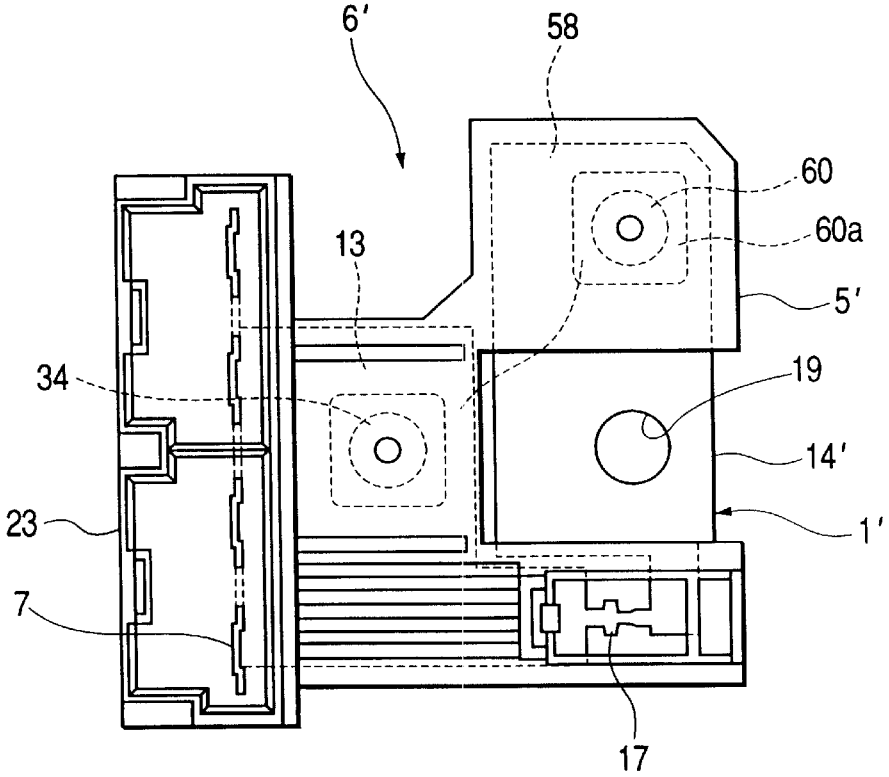
FIG. 9 is a bottom view illustrating the fuse unit that is the second embodiment of the present invention.
Figure 8:
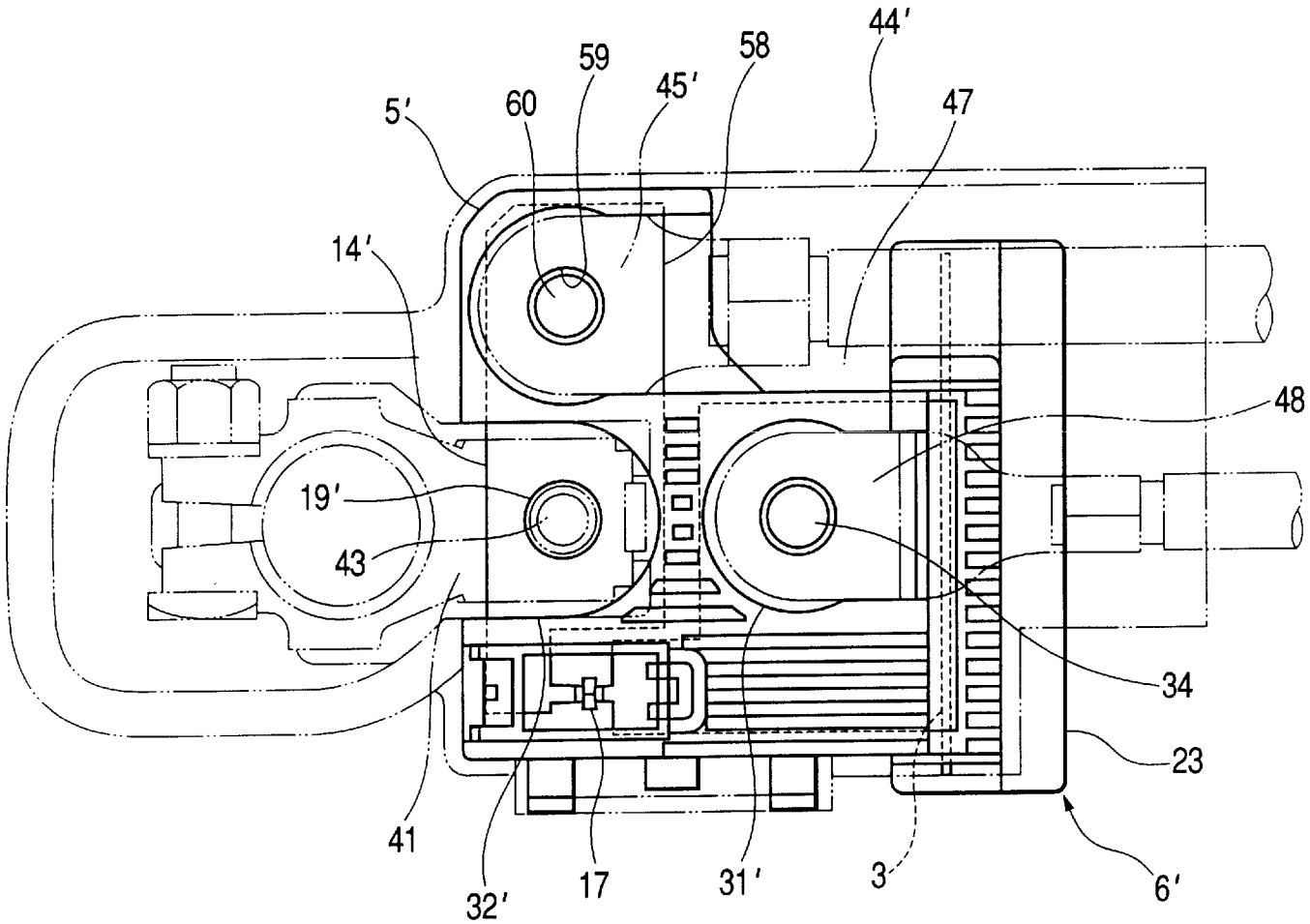
FIG. 8 is a plan (or top) view illustrating another fuse unit that is a second embodiment of the present invention.

FIGS. 8 and 9 illustrate another fuse unit, which is a second embodiment of the present invention. Incidentally, the same reference characters designate the same constituent elements of the first embodiment. Thus, the description of such constituent elements is omitted herein. Each of constituent elements similar to the corresponding constituent elements of the first embodiment is denoted by reference character obtained by putting a prime symbol after the same reference numeral as reference numeral designating the corresponding constituent element of the first embodiment.

In this fuse element 6', the third plate portion 14' of the fuse element 1' made of an electrically conductive material is extended sideways and projected, differently from the fuse unit 6. The second resin body part 5' is extended to and covers the rear surface (or bottom surface) side and the peripheral portion of this projected extension part 58. The top surface of the projected extension portion (namely, the terminal contact portion) 58 is exposed from the resin body part 5'. A second terminal 45' for connecting the starter motor is brought into contact with this exposed surface of the portion 58.

The projected extension part 58 of the third plate portion 14' extends in a direction orthogonal to a straight line connecting the stud bolt 43 provided in the battery terminal 41 to the stud bolt 34 provided in the second plate portion 13. A bolt insertion hole 59 is provided in the central portion of the projected extension part 58. A stud bolt 60 is inserted into the bolt insertion hole 59. A head portion 60*a* of the stud bolt 60 is fixed by integrally forming the resin body part 5'. A straight line connecting this stud bolt 60 to the battery-terminal-side stud bolt 43 is orthogonal to the straight line connecting the stud bolt 43 to the stud bolt 34. The stud bolt 60 provided in the projected extension part 58 is disposed in parallel with the stud bolt 43 provided in the battery terminal 41. A terminal connecting portion comprises the projected extension part (namely, the terminal contact portion) 58 and the stud bolt 60. A power supply connecting portion comprises the bolt insertion hole 19' and the terminal contact portion 32'. Another terminal connecting portion comprises the stud bolt 34 and the terminal contact portion 31'.

The second terminal 45' for connecting the starter motor has a straight substrate portion (also designated by reference character 45' ) and a bolt insertion hole provided in the central part (also denoted by reference numeral 59) of this substrate portion, similarly as the first terminal 48 for connecting the alternator. The second terminal 45' is connected to the fuse element 1' at the side opposite to the battery terminal 41, that is, at the front side in a state in which the second terminal is in parallel with the first terminal 48. The fuse unit 6' is attached to the battery by engaging the insertion hole provided in the second terminal 45' with the stud bolt 60 provided in the third plate portion of the fuse element 1, instead of the stud bolt 43 provided in the battery terminal, and tightening the bolt 60 with a nut, and connecting the bolt 60 thereto. Thereafter, the first terminal 48 and the second terminal 45' can be connected to the fuse unit 6'. Thus, restrictions on the connecting procedure are removed. Because of no restrictions on the connecting procedure, the fuse unit 6' can be connected to the battery after, for example, the first terminal 48 and the second terminal 45' provided in the fuse unit 6' are connected and fixed. The second terminal 45' is accommodated in the cover 45' by being placed in parallel with and being opposite in direction to. the battery terminal 41.

A circuit diagram illustrating the circuit configuration of the second embodiment is similar to that (see FIG. 7) in the case of the first embodiment. The circuit configuration of the second embodiment is almost the same as of the first embodiment, except the arrangement of the second terminal 45'. Reference numeral 17 designates a fusible portion. The fusible portion 17 connects the third plate portion 14', which is connected to the battery, to the second plate portion 13 provided at the side of the hinge portion 3. Reference numeral 23 denotes a connector. Reference numeral 7 designates tab terminals provided in the connector 23. The tab terminal 7 connects the fusible portion 2 to the wide first plate portion (see FIG. 5) through the second plate portion 13 and the hinge portion 3. Such a structure is similar to that in the case of the first embodiment.

Although the resin body is bent at right angles in each of the aforementioned embodiments so that the first resin body part 4 is perpendicular to the second resin body part 5, the bending angle can be set at an angle other than a right angle. The bending angle can be set at a desired angle by changing the angle between the joining surfaces 30 (see FIG. 2) of the opposed end portions of the resin body parts 4 and 5. The hinge portion 3 provided in the middle portion of the fuse element 1 is not necessarily exposed. In view of the insulating properties, each of the resin body parts 4 and 5 can be covered with flexible thin resin film integrally formed therewith. Furthermore, the fuse unit 6 can be used at a part other than the battery. The connector 23 can be provided in the second resin body part 5 connected to the battery, instead of being provided in the first resin body part 4. The first resin body part 4 can be bent upwardly from the hinge portion 3, instead of being bent downwardly therefrom. In this case, the electric wires 46 and 54 and the terminals 45 and 48 are drawn in a direction in which no interference between the connector 23 and each of the wires 46 and 54 and the terminals 45 and 48 occurs. The second plate portion 13 and the third plate portion 14 of the fuse element 1 can be integrally formed without interposing the fusible portion 17 therebetween. A bolt insertion hole for connecting terminals to the first plate portion 12 and/or the second plate portion 13 can be provided. The resin body can be divided into three or more parts by providing flexible hinge portions 3 at two or more places.

Third Embodiment

FIGS. 10 to 14 showing another fuse unit that is a third embodiment of the present invention. The same reference characters designate the same constituent elements of the first embodiment. Thus, the detail description of such constituent elements is omitted herein.

In this fuse unit 64, a fuse element 69 having plate portions 66 to 68, which are provided at the front-side and rear-side of the hinge portion 65, is divided into left-side and right-side division portions by a slit portion 70 extending in a direction perpendicular to a direction in which the hinge portion 65 extends. A battery terminal 71 and a second terminal 72 (see FIG. 11) are connected to the front side of the left-side division portion 67. The right-side division portion 68 is connected through a fusible portion 73 to the front side of the left-side division portion 67 (see FIG. 10) so that the portions 67 and 68 are parallel to each other. A second terminal 92 is connected to a middle portion of the right-side division portion 68. A rear half side of each of the division portions 67 and 68 is downwardly bent from a corresponding one of the hinge portions 65 (see FIG. 11). The tab terminals 7 for the connector 23 (see FIG. 12) are provided at the bent side 66 in such a manner as to be separated correspondingly to each of the division portions. This fuse unit is adapted so that a third terminal (not shown) can be connected to the middle portion of the left-side division portion 67. A first terminal 92 and a second terminal 72 (see FIGS. 11 and 12) are downwardly bent in such a manner as to be able to be accommodated in the inner space 93 (FIG. 11) between the battery 40 and the connector 23.

Figure 10:
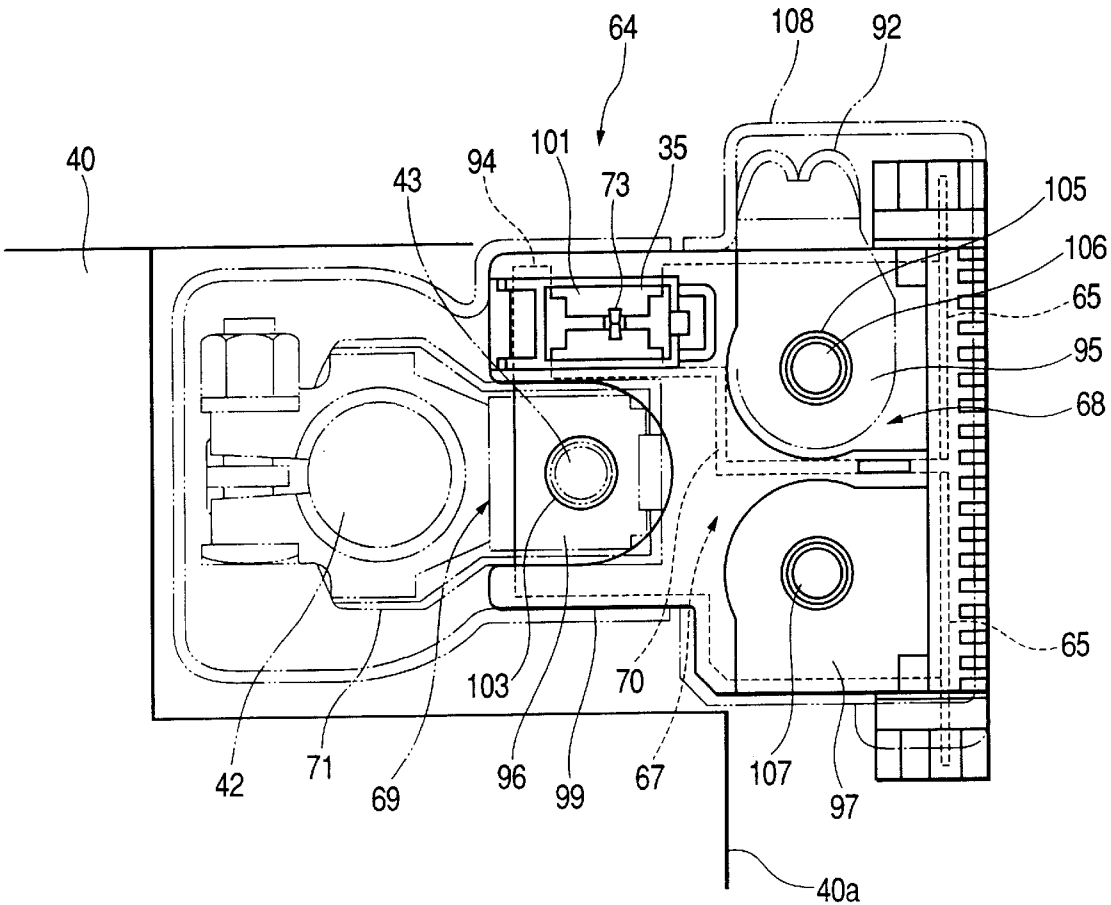
FIG. 10 is a plan (or top) view illustrating another fuse unit that is a third embodiment of the present invention.
Figure 12:
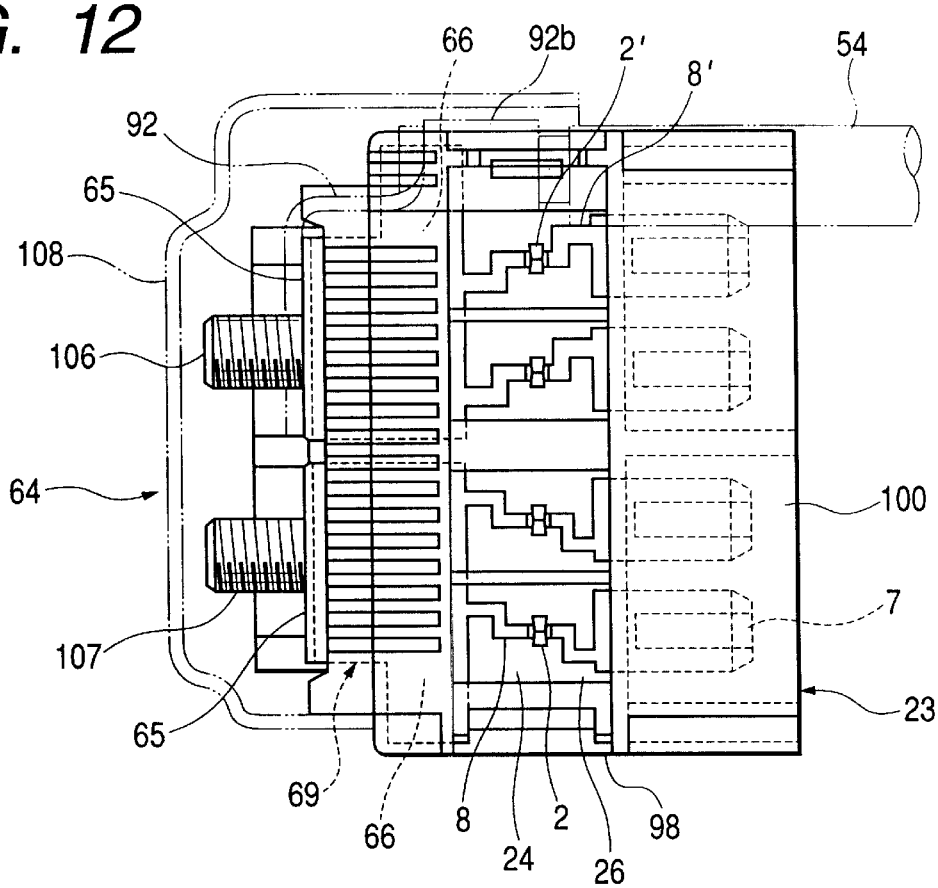
FIG. 12 is a front view illustrating this fuse unit.
Figure 13:
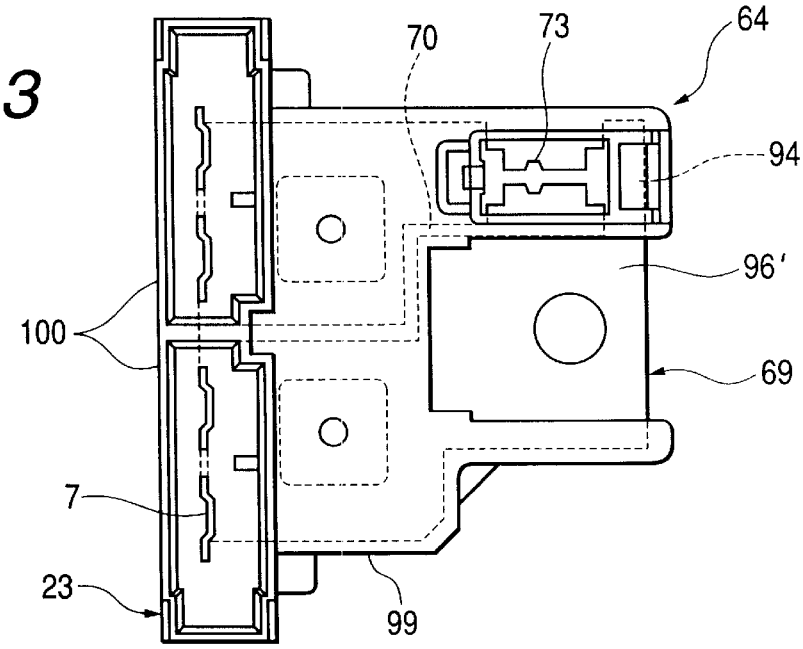
FIG. 13 is a bottom view illustrating this fuse unit.

As illustrated in FIGS. 10 and 13, the slit portion 70 is formed like a crank in a horizontal portion of the fuse element 69. The left-side division portion 67 and the right-side division portion 68 are connected to each other at a narrow transversal extension portion 94 in the front end portion of the fuse element 69. The extension portion 94 is connected to the fusible portion 73 that leads to the right-side division portion 68. Each of the left-side division portion 67 and the right-side division portion 68, which are separated from each other, leads to a corresponding one of the hinge portions 65 (see FIG. 12) in the middle portion of the fuse element 69, and is downwardly (namely, vertically) bent from the hinge portion 65. Each of the vertical division portions (or plate portions) 66 leads to the tab terminals 7 at the side of the connector 23 through a corresponding one of two fusible portions 2 and 2' (see FIG. 12). The crank-like thin portions 8 and 8' respectively having the left-side fusible portion 2 and the right-side fusible portion 2' are placed in such a manner as to be symmetrical with respect to the longitudinal center axis of the fuse element 69.

The fuse element 69 including the slit portion 70 other than the two hinge portions 65, namely, the left-side and right-side hinge portions 65 and the terminal contact portions (corresponding to the exposed surfaces) 95 to 97 is covered with resin body parts 98 and 99. The rear-side (or first) resin body part 98 includes a connector housing 100 (see FIG. 13). The front-side (or second) resin body part 99 is adapted so that the terminal contact portions 95 to 97 of the fuse element 69 are exposed at the front side and both the right and left sides thereof. Each of the fusible portions 2, 2' and 73 is accommodated in a corresponding one of the cavities 24 and 35 and covered with a corresponding one of small covers 26 and 101.

Figure 11:
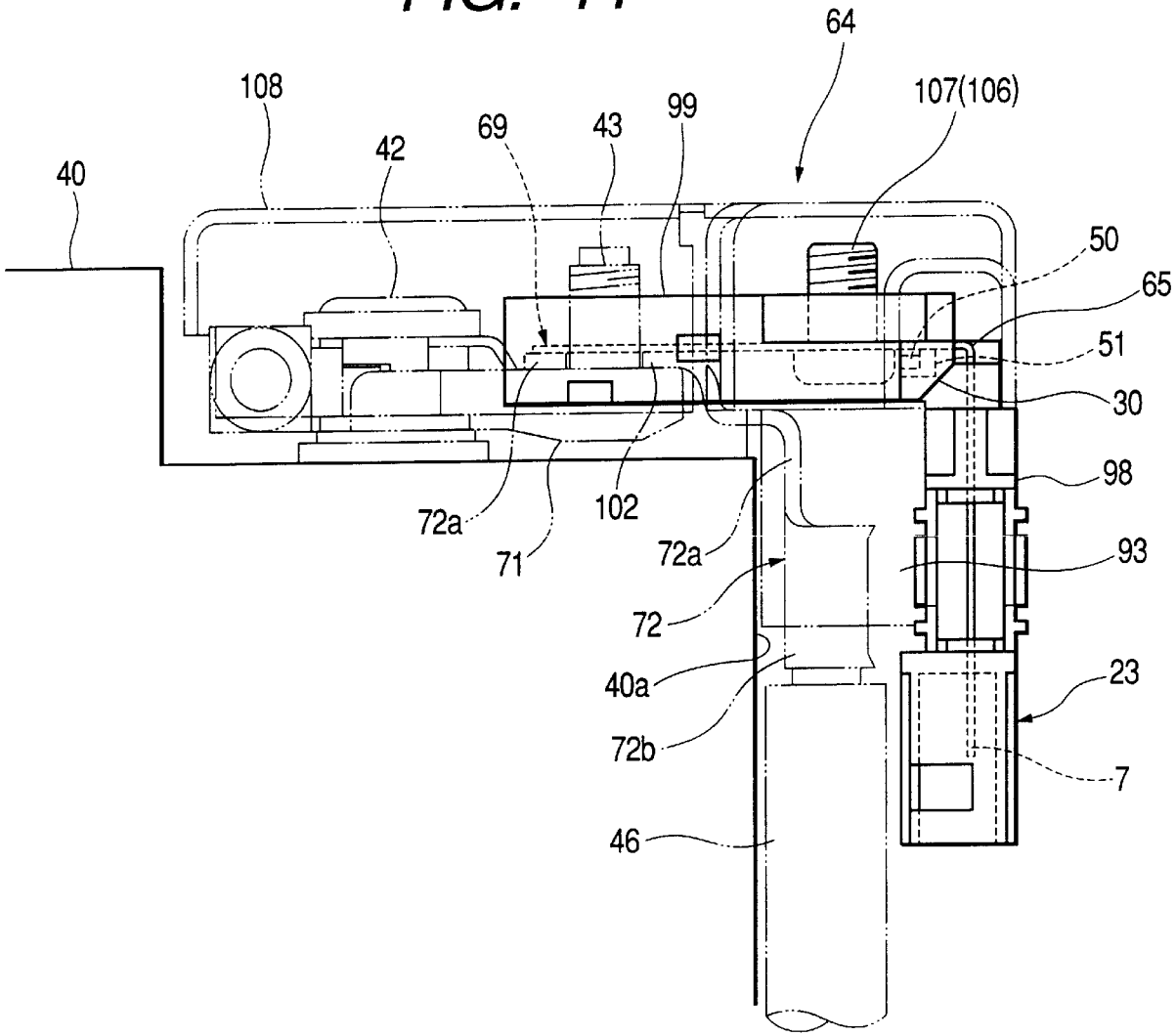
FIG. 11 is a side view illustrating this fuse unit.

As illustrated in FIGS. 10 and 11, the stud bolt 43 of the battery terminal 71 is inserted into an insertion hole of an electric contact portion 72*a* of the second terminal 72 and into an insertion hole 103 of a front-side terminal contact portion 96 of the fuse element 69. The fuse element 69 and the second terminal 72 are bolted and connected together to the battery terminal 71. The second terminal 72 is brought into contact with the bottom surface (or exposed surface) 96' (see FIG. 13) of the terminal contact portion 96. Thus, the battery terminal 71 is put into contact with the bottom surface of the second terminal 72. The terminal connecting portion is formed by the stud bolt 43 and the terminal contact portion 96. The power supply connecting portion is formed by the insertion hole 103 and the bottom surface 96' of the terminal.

The fusible portion 73 is placed on the (right) side of the front-side terminal contact portion 96 in parallel therewith. The electrical contact portion 72*a* of the second terminal 72 (see FIG. 11) is downwardly bent in a two-stage manner and connected to an electric wire clamping portion 72*b*. The electric wire clamping portion 72*b* and an electric wire 46 are downwardly arranged along a side wall 40*a* of the battery 40, and placed between the side wall 40*a* and the first resin body part 98, which is parallel to the wall 40*a*. The battery terminal 71 is connected to a battery post (namely, a positive electrode) 42.

A stud bolt 106 (see FIGS. 10 to 12) is inserted into an insertion hole 105 of the right-side terminal contact portion (or exposed surface) 95. The head of the stud bolt 106 is fixed to a second resin body part 99. The top surface of the terminal contact portion 95 is exposed. An insertion hole (also designated by reference numeral 105) provided in the first terminal 92 engages with the stud bolt 106. The bottom surface. of the first terminal 92 is brought into contact with the top surface of the terminal contact portion 95. The terminal contact portion 95 and the stud bolt 106 constitute the terminal connecting portion. The first terminal 92 (see FIG. 12) is bent nearly like a letter "L". The wire clamping portion 92*b* and the electric wire 54 are downwardly disposed along the bottom surface of the wide first resin body part 98. Almost the entire electric wire 54 is accommodated in The space of width, which is equal to that of the first resin body part 98.

The left-side terminal contact portion 97 (see FIG. 97) is placed in parallel with the right-side terminal contact portion 95 to be connected to the first terminal 92. A stud bolt 107

(see FIGS. 10 to 12) is inserted into an insertion hole of the terminal contact portion 97. A head portion of the stud bolt 107 is fixed to the second resin body part 99. A pair of the left-side stud bolt 106 and the right-side stud bolt 107 are placed in parallel with each other. A third terminal (not shown) is connected to the top surface of the left-side terminal contact portion 97, similarly as the second terminal 92. The third terminal is downwardly bent, and the electric wire clamping portion and the electric wire thereof are downwardly arranged along the bottom surface of the first resin body 98 and along the side wall surface 40*a* of the battery 40 within the range of width that is nearly equal to the width of resin body part 98. The terminal contact portion 97 and the stud bolt 107 constitute the terminal contact portion recited in the appended claims.

The addition of the third terminal to the fuse unit results in increase in the number of junction circuits. Moreover, the first to third terminals 92 and 72 and the electric wires 54 and 46 are accommodated between the first resin body part 98 and the battery 40 within the range of width that is equal to the width of the first resin body part 98. Thus, the structure around the fuse unit 64 becomes compact. The length of the part projected from the battery 40 illustrated in FIG. 11 is reduced by downwardly bending the first resin body part 98 from the hinge portion 65.

In the fuse unit 64, the entire second resin body part 99 and the top portion of the first resin body part 98 are covered with the cover 108. The terminals 72 and 92 and the electric wires 46 and 54 connected thereto are placed under the cover 108 and thus protected from water drops. As illustrated in FIG. 11, the resin body parts 98 and 99 abut against the abutting faces, which are inclined at 45° to horizontal, and are perpendicular to each other and caught by the engaging means (that is, the catch projection 50 and the engaging frame portion 51). The hinge portion 65 does not have an upwardly projecting curved portion as provided in the aforementioned portion. The horizontal portion and the vertical (or bending) portion of the fuse element 69 are slightly curved like what is called an R-curve, and smoothly orthogonal to each other. As illustrated in FIGS. 12 and 13, the connector 23 is divided into left-side and right-side parts. The first terminal 92 and the second terminal 72 are respectively connected to the two tab terminals 7 (see FIG. 12) provided in the connector housing 100.

Figure 14:
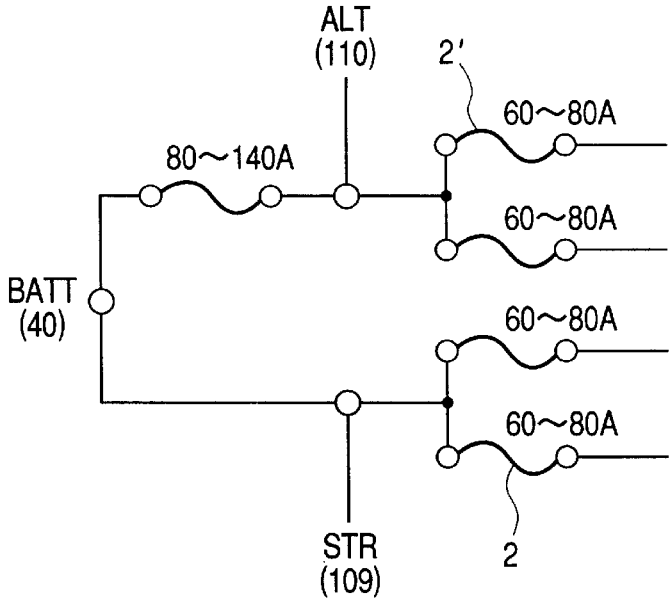
FIG. 14 is a circuit diagram illustrating a connected state of this fuse unit that is third embodiment of the present invention.

FIG. 14 illustrates a junction circuit form. A power supply current is supplied from the battery 40 through the second terminal 72 to a starter motor 109, and also supplied to an electric connection box through the fusible portion 2 and the left-side tab terminal 7 of the connector 23 (see FIG. 12). During the engine running, a charging current sent from the alternator 110 through the first terminal 92 is branched. One of the branched charging current is sent to the battery 40 through the fusible portion 73 of 80 to 140 ampere fuse, the other branched charging current is sent to the electric connection box through the fusible portion 2' of 60 to 80 ampere fuse and the right-side tab terminal 7 of the connector 23 (FIG. 12). During the engine stopping, a power supply current is supplied from the battery 40 and sent to the electric connection box through the fusible portion 2' and the tab terminal 7.

It makes it possible to simplification and miniaturization of the specification of a relay block or the like by providing a fuse circuit in the front of the alternator instead of providing in the relay block. This construction of the invention is especially effective in the vehicle having the large battery 40 onto a small space thereof (for example electric vehicle).

The third terminal is for sending the power supply current from the battery 40 to another circuit (wire). It is possible to connect the third terminal side wire to starter motor 109, instead of the second terminal 72.

Fourth Embodiment

Figure 15:
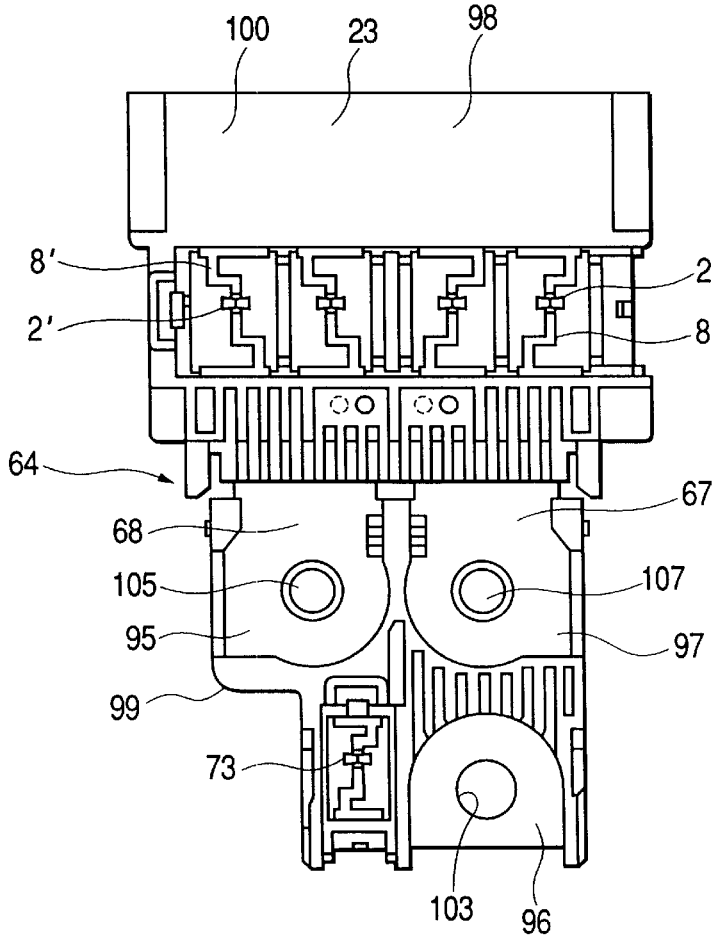
FIG. 15 is a plan view illustrating a fuse unit, which is a forth embodiment of the present invention.
Figure 16:
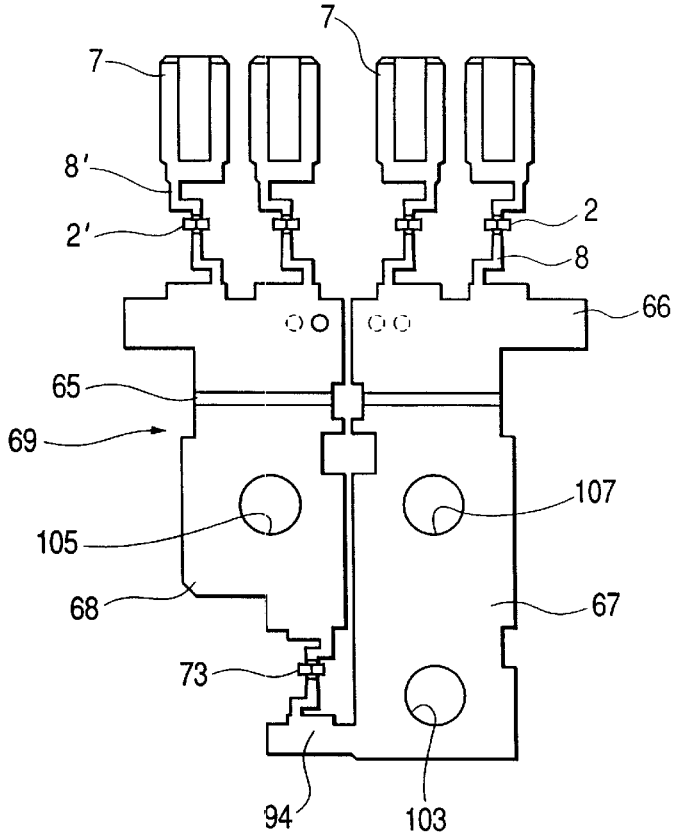
FIG. 16 is a plan view illustrating a fuse element of a fuse unit that is the forth embodiment of the present invention.
Figure 17:
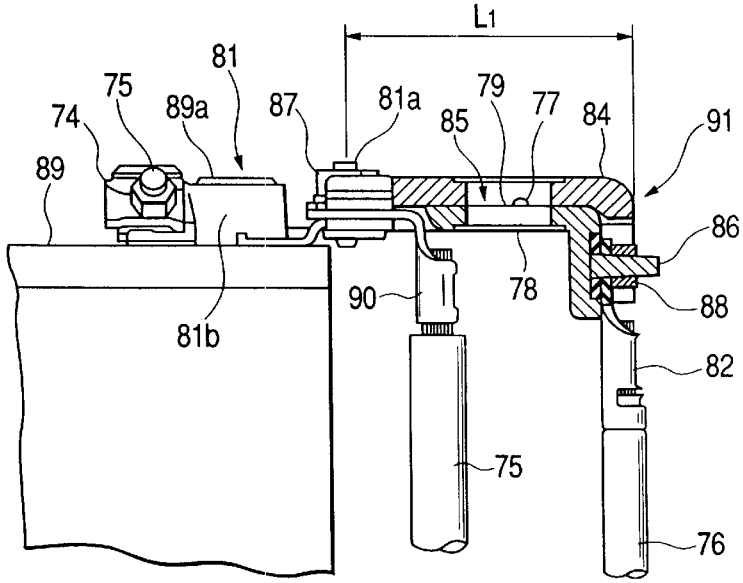
FIG. 17 (PRIOR ART)
FIG. 17 is a sectional side view illustrating a primary part of a related fuse unit.

FIGS. 15 and 16 show the fuse unit according to a forth embodiment of the present invention. The same reference characters designate the same constituent elements of the third embodiment. Thus, the detail description of such constituent elements is omitted herein.

The difference between the third embodiment and the fourth embodiment is that the slit portion 70 dividing the fuse element into right in two parts (i.e. the right side fuse element and the left side fuse element) is formed in straight-line. Therefore, the left-side division portion 67 and right-side division portion 68 have approximately same width. The left-side division portion 67 is extended toward thee battery post 71 longer than the right-side division portion extending. The left-side and right-side division portions 67, 68 are connected together at the distal end portion of the fuse element 69 through an extending portion 94 and the fusible portion 73. The second terminal 72 an the third terminal aligned each other are connected to the left-side division portion 67.

This configuration enables to prevent an interference with another parts by forming whole of the fuse element 69 or the fuse element into compact shape. Since the circuit configuration and the other configuration of the forth embodiment are same as the third embodiment, the detailed description of the junction circuit and the other configuration is omitted.

As described above, according to the present invention, the resin body can be integrally formed with the fuse element in a state in which the fuse element is planarly flattened out. Thus, there is no necessity for forming the resin body into a bent shape as in the conventional fuse unit. Consequently, the drawing direction can be the direction of 180°. The molding die is simplified in structure and reduced in cost. A fuse unit of a complex shape can easily be formed. Further, a fuse unit can be conveyed and carried in a state in which the fuse unit is planarly flattened out. Thus, the conveyance of the fuse units is facilitated. Moreover, the style of packing the fuse units is compacted.

Further, a bending angle can be determined by causing one of the resin body parts to abut the abutting face of the other resin body part. Thus, the fuse unit can be bent at an arbitrary angle by setting a tilting angle of each of the abutting faces at a given value.

The resin body parts are prevented by catching both the resin body parts by means of the catch means from being brought into wide contact with each other owing to the vibration of a vehicle during running. Thus, the hinge portion can be prevented from being damaged.

A connector for accommodating t he terminals is constructed in the resin body. Consequently, a wire harness can easily be connected to this fuse unit by connector connection. Moreover, a plurality of power feeding circuits can be simultaneously constructed.

The connector accommodating the terminals is placed in, for example, a vertical direction by performing an operation of bending the resin body. Thus, an amount of projection in a horizontal direction of the connector from the battery and a counter connector can be reduced. Moreover, a lead wire of the counter connector can be cabled along the battery in a vertical direction. Consequently, the space required for an engine room can be saved.

Electric power is supplied to each of the terminals of the connector through the latter plate portion, the hinge portion and the fusible portion. A plurality of power feeding circuits can easily be constructed by connector connection.

External terminals are connected to the latter plate portion. Electric currents and signals are supplied from the external terminal to the terminals of the connector. This enables the diversification of the circuit form thereof.

The power supply is connected to the third plate portion. The first terminal is connected to the second plate portion. Consequently, electric current is supplied from, for instance, the first terminal through the second plate portion to the terminal of the connector. Thus, the number of power feeding circuits is increased at the terminal of the connector and the first terminal.

The second terminal is disposed by utilizing the side space that is a dead space. Thus, a compact space-saving connecting structure is realized.

The second terminal is bent, so that the second terminal can be connected to the power supply connecting portion from side (that is, from the side-space side) and that the side space can be effectively utilized. Moreover, the second terminal is connected to the projected extension part of the second latter plate portion, so that the second terminal can be made to be straight during the second terminal is placed in the side space. Thus, the second terminal is simplified in structure and reduced in cost. Furthermore, a connecting portion corresponding to the second terminal is provided in addition to the power supply connecting portion, so that the second terminal can be connected to this connecting portion after the power supply connecting portion is connected to the battery. Consequently, the flexibility in a connecting procedure is increased.

The fuse element consisting of the former plate portion and the latter plate portion is divided into the division portions. The first terminal is connected through one of the division portions to one of the terminals accommodated in the connector. The second terminal is connected through the other division portion to another of the terminals accommodated in the connector. Thus, outputs from the first and second terminals are simultaneously and separately supplied from the connector. This enables the diversification of the circuit form of the fuse unit.

The first and second terminals are accommodated in the space between the resin body and the battery. Thus, a compact space-saving structure surrounding the fuse unit is realized.

Furthermore, according to the thirteenth fuse unit, electric power can be supplied from. the third terminal to other circuits. Thus, the diversification of the circuit form of the fuse unit is achieved.

According to first manufacturing method of the fuse unit of the present invention, advantageous effects similar to those of the fuse unit are obtained. That is, the first manufacturing method eliminates the necessity for forming the resin body into the bent shape similarly as in the case of the conventional manufacturing method. It is sufficient that only a direction of 180° (namely, an upward or downward direction) is employed as the drawing direction. The structure of the molding die is simplified. The manufacturing cost of the fuse unit is reduced. A fuse unit of a complex shape can easily be formed.

Spaces, in each of which a fusible portion is exposed to the resin material provided on a corresponding one of both sides of the hinge portion, can easily be formed by performing an operation of drawing in the direction of 180°. Thus, the flexibility in arrangement of the fusible portions is increased. The number of available fusible portions can be increased. Thus, the fuse unit can cope with the diversification and complicating of the configuration of a power feeding circuit.

The terminal contact portion is formed at one end of the fuse unit simultaneously with the forming the connector connecting portion at the other end of the fuse unit. Thus, the diversification of the circuit form is enabled by the connection between the external terminal and the connector.

What is claimed is:

1. A fuse unit comprising:

an electrically conductive fuse element including at least one fusible portion;

a hinge portion provided at said electrically conductive fuse element so that said electrically conductive fuse element is separated into a first fuse element and a second fuse element by said hinge portion and is bendable from said hinge portion;

a first resin body provided at said first fuse element; and a second resin body provided at said second fuse element.

2. The fuse unit according to claim 1, wherein said first and second resin bodies are respectively provided with abutting faces abutted together when said electrically conductive element is bent from said hinge portion.

3. The fuse unit according to claim 1 further comprising an engaging mechanism for engaging said first and second resin bodies each other when said electrically conductive element is bent from said hinge portion.

4. The fuse unit according to claim 1 wherein at least one first terminal is provided at said electrically conductive fuse element through said corresponding fusible portion, at least one connector housing for accommodating said at least one first terminal is provided in at least one of said first and second resin body.

5. The fuse unit according to claim 4, wherein a plurality of said terminals are provided in parallel with one another at said first fuse element, a power supply connecting portion is provided at said second fuse element.

6. The fuse unit according to claim 5, wherein at least one terminal connecting portion is provided at said second fuse element.

7. The fuse unit according to claim 5, wherein said second fuse element is formed of a first fuse plate connected Lo said hinge portion and a second fuse plate connected to said first fuse plate through one of said fusible portion, one of said at least one terminal connecting portion for a second terminal is provided at said first fuse plate, said power supply connecting portion is provided at said second fuse plate.

8. The fuse unit according to claim 7, wherein said second fuse element is narrower than said first fuse element, a third terminal is placed in a side space at a side of said second fuse element and connected to said power supply connecting portion.

9. The fuse unit according to claim 7, wherein said first fuse plate is narrower than said first fuse element, said second fuse plate to which a third terminal is connected is placed in a side space at a side of said first fuse plate.

10. The fuse unit according to claim 6, wherein said electrically conductive fuse element is divided in a direction perpendicular to a direction, in which said hinge portion extends, into a first division portion including a part of said first fuse element and a second division portion including the other part of said first fuse element, said first division portion is connected to said second division portion through one of said fusible portions, said first and second division portion are respectively provided with said first terminals and a second terminal.

11. The fuse element according to claim 10, wherein said third terminals are positioned between said first fuse element and a battery.

12. The fuse element according to claim 10, wherein said first terminal is for connecting an alternator, said second terminal is for connecting a starter motor, a current branched from said first terminal is supplied to an electric connection box through said fusible portion and said first terminal.

13. A method of manufacturing a fuse unit comprising the steps of:

providing an electrically conductive fuse element including at least one fusible portion;

forming a hinge portion at said electrically conductive fuse element for dividing said electrically conductive fuse element into a first fuse element and a second fuse element; and integrally forming an insulating resin material with said first and second fuse elements in a state in which said electrically conductive fuse element is flattened out.

14. The method of manufacturing the fuse unit according to claim 13, wherein said insulating resin material is formed with opposite sides of said first and second fuse elements.

15. The method of manufacturing the fuse unit according to claim 14, wherein a space, to which said at least one fusible portion is exposed, is formed at said insulating resin material.

16. The method of manufacturing the fuse unit according to claim 15, wherein a connector housing for accommodating a terminal connected to one of said at least one fusible portion is formed at said insulating resin material.

17. The method of manufacturing the fuse unit according to claim 15, wherein a exposed portion of said second fuse element corresponding to a terminal contact portion is formed at said insulating resin material.

* * * * *